US010859320B2

(12) United States Patent
Lin et al.

(10) Patent No.: US 10,859,320 B2
(45) Date of Patent: Dec. 8, 2020

(54) THERMAL MODULE ASSEMBLING STRUCTURE

(71) Applicant: ASIA VITAL COMPONENTS CO., LTD., New Taipei (TW)

(72) Inventors: Sheng-Huang Lin, New Taipei (TW); Kuo-Sheng Lin, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 123 days.

(21) Appl. No.: 16/199,213

(22) Filed: Nov. 25, 2018

(65) Prior Publication Data

US 2019/0162479 A1 May 30, 2019

Related U.S. Application Data

(63) Continuation-in-part of application No. 14/184,433, filed on Feb. 19, 2014, now abandoned.

(51) Int. Cl.
*F28D 15/02* (2006.01)
*F28F 3/12* (2006.01)

(52) U.S. Cl.
CPC ..... *F28D 15/0275* (2013.01); *F28D 15/0233* (2013.01); *F28F 3/12* (2013.01); *F28F 2275/122* (2013.01)

(58) Field of Classification Search
CPC ..... F28D 15/0275; F28D 15/04; F28D 2015/0216; F28D 15/0233; F28F 9/00; F28F 3/12; F28F 2275/122; H01L 23/40
See application file for complete search history.

(56) References Cited

U.S. PATENT DOCUMENTS 5,983,995 A * 11/1999 Shutou ..... B23P 11/00 165/104.33
8,985,194 B2 * 3/2015 Lin ..... F28D 15/02 165/80.2

* cited by examiner

*Primary Examiner* — Jon T. Schermerhorn, Jr.
(74) *Attorney, Agent, or Firm* — Thomas J. Nikolai; DeWitt LLP

(57) ABSTRACT

A thermal module assembling structure includes a heat dissipation board and at least one heat pipe. The heat dissipation board has a receiving channel for fitting the heat pipe therethrough. Two sides of upper side of the receiving channel are respectively formed with two ribs. The ribs horizontally protrude and extend toward the middle of the receiving channel to face the heat pipe fitted in the receiving channel. At least one deformed recess is formed on an upper surface of each of the ribs, whereby the lower surfaces of the ribs and a surface of the heat pipe are deformed to form at least one deformed connection section between the lower surfaces of the ribs and the surface of the heat pipe. By means of the restriction of the deformed connection section, the heat pipe is prevented from being extracted out of the receiving channel.

6 Claims, 21 Drawing Sheets

THERMAL MODULE ASSEMBLING STRUCTURE

The present application is a continuation in part of U.S. patent application Ser. No. 14/184,433, filed on Feb. 19, 2014.

BACKGROUND OF THE INVENTION

1. Field of the Invention

The present invention relates generally to a thermal module assembling structure, and more particularly to a thermal module assembling structure in which the heat dissipation board and the heat pipe are deformed to restrict each other.

2. Description of the Related Art

A prior art discloses a heat dissipation substrate structure. A heat pipe is embedded in the heat dissipation substrate and then riveted with the heat dissipation substrate by means of mechanical riveting. After riveted, the rivet is closed up to keep the surface of the heat dissipation substrate a plane face. The heat dissipation substrate includes a receiving channel formed in the heat dissipation substrate structure for receiving the heat pipe. Two ribs are formed on two sides of the receiving channel in immediate adjacency to each other. The two ribs are higher than the surface of the heat dissipation substrate structure. Two material escape receptacles are formed in the heat dissipation substrate structure in immediate adjacency to outer sides of the ribs respectively. Accordingly, when the heat pipe is embedded into the heat dissipation substrate and riveted with the heat dissipation substrate by means of mechanical riveting, the ribs hold the heat pipe and the material escape receptacles receive the residual metal produced in the mechanical riveting and close-up process of the ribs. Therefore, the surface of the heat dissipation substrate structure can keep plane.

The above heat dissipation substrate structure is able to prevent the heat pipe from being extracted out of the substrate. However, in practice, the ribs and the receiving channel simply embrace the circumferential surface of the heat pipe. Therefore, the heat pipe is still likely to be extracted out of the receiving channel in the lengthwise direction of the receiving channel, (that is, the axial direction of the heat pipe).

SUMMARY OF THE INVENTION

It is therefore a primary object of the present invention to provide a thermal module assembling structure. In the thermal module assembling structure, the mating faces of the two ribs on two sides of the receiving channel of the heat dissipation board and the heat pipe in the receiving channel are locally deformed to form at least one deformed connection section for tightly fitting and connecting the heat pipe with the ribs.

It is a further object of the present invention to provide the above thermal module assembling structure in which the deformed connection section between the mating faces of the ribs and the heat pipe is substantially normal to the axis of the heat pipe so as to apply an interference force to the heat pipe to prevent the heat pipe from being extracted out of the receiving channel along the length thereof.

To achieve the above and other objects, the thermal module assembling structure of the present invention includes a heat dissipation board having a receiving channel formed in the heat dissipation board for a heat pipe to fit through the receiving channel. Two sides of upper side of the receiving channel are respectively formed with ribs, which horizontally protrude and extend toward the middle of the receiving channel. Each rib has an upper surface and a lower surface. The lower surface faces a surface of the heat pipe. At least one deformed recess is formed on the upper surface of each of the ribs, whereby the lower surfaces of the ribs and the surface of the heat pipe are deformed to form at least one deformed connection section between the lower surfaces of the ribs and the surface of the heat pipe.

In the above thermal module assembling structure, the deformed connection section is substantially normal to an axis of the heat pipe.

In the above thermal module assembling structure, the deformed connection section includes a deformed raised portion and a deformed recessed portion. The deformed raised portion is formed on the lower surface of the rib. The deformed recessed portion is formed on the surface of the heat pipe.

In the above thermal module assembling structure, the deformed raised portion and the deformed recessed portion are tightly fitted and engaged with each other to restrict each other.

By means of the restriction of the deformed connection section, the heat pipe is truly prevented from being extracted out of the receiving channel along the length of the receiving channel.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
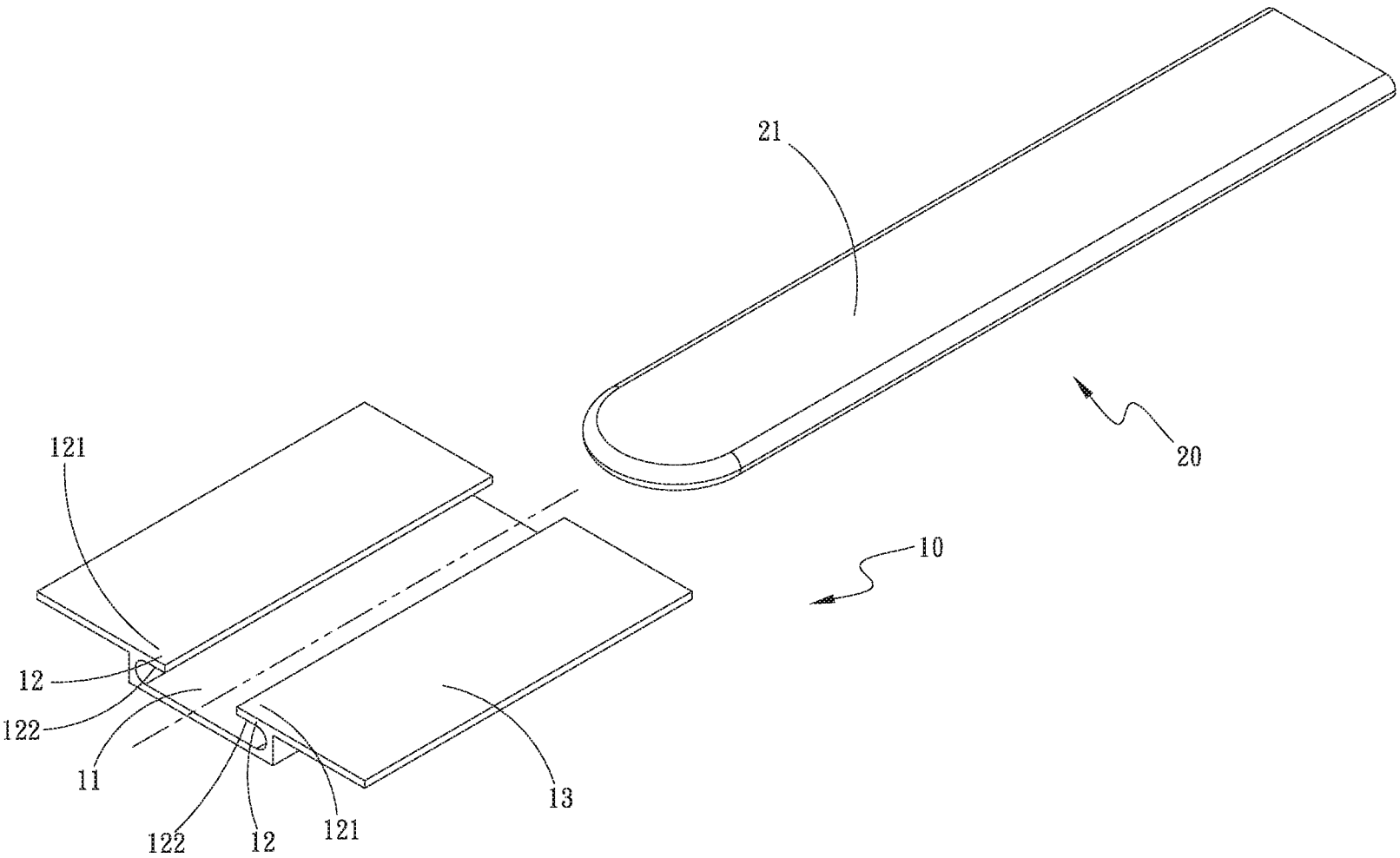
FIG. 1 is a perspective exploded view of a first embodiment of the heat dissipation board and heat pipe of the present invention.

The embodiments of the present invention will be described hereinafter with reference to the drawings, wherein the same components are denoted with the same reference numerals.

Figure 2A:
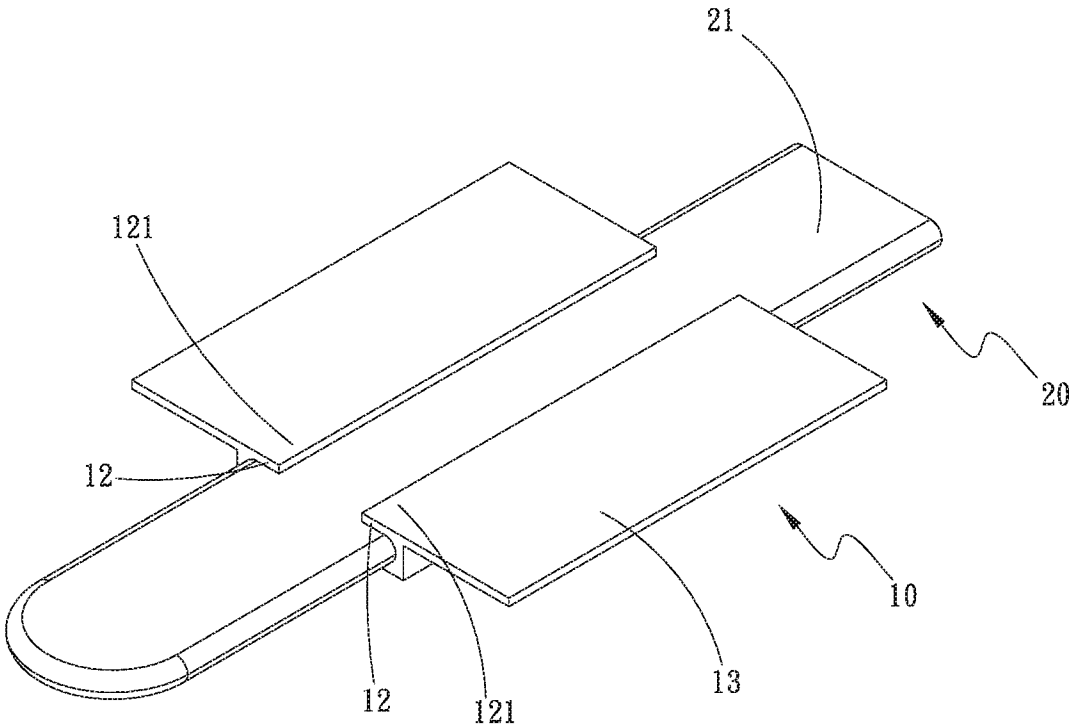
FIG. 2A is a perspective assembled view of a first embodiment of the heat dissipation board and heat pipe of the present invention.
Figure 2B:
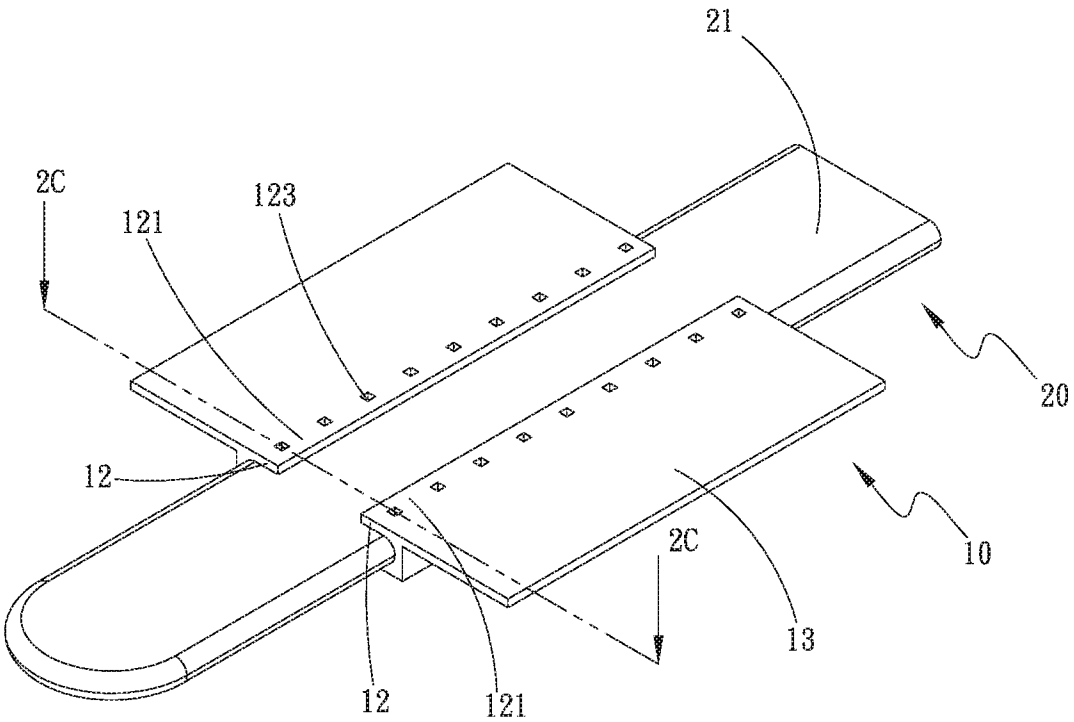
FIG. 2B is a view of a first embodiment showing that the ribs are formed with deformed recesses.
Figure 2C:
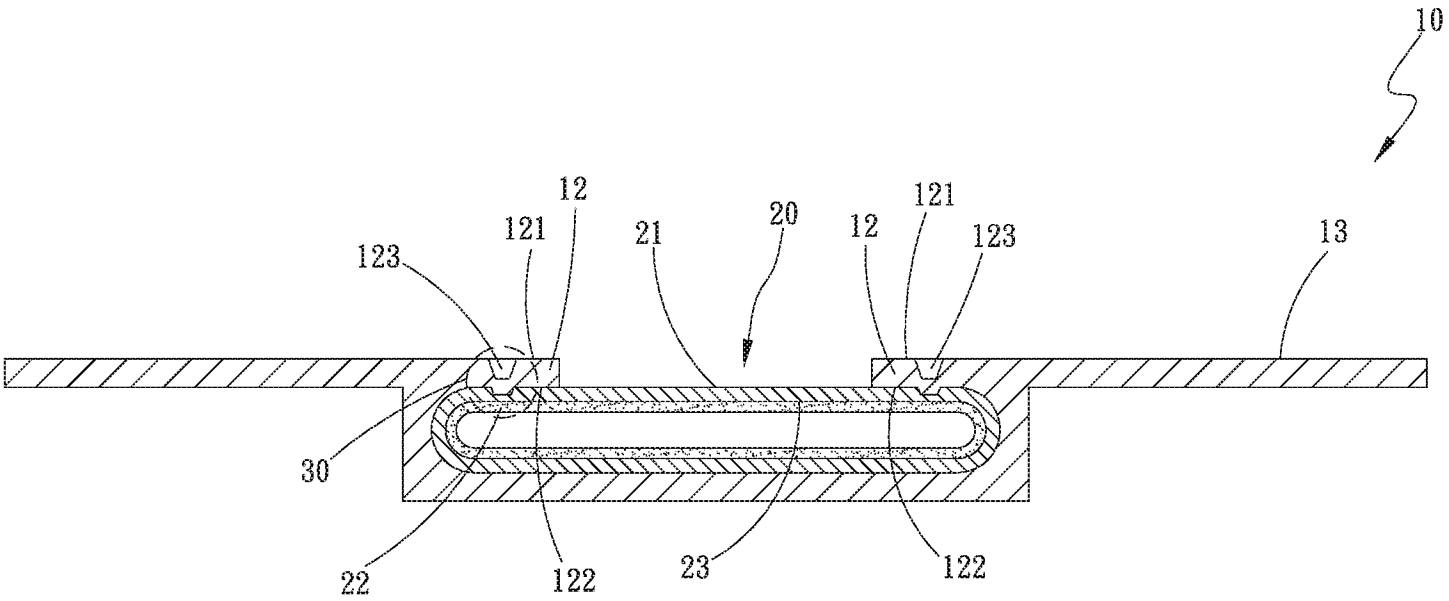
FIG. 2C is a sectional view taken along line 2C-2C of FIG. 2B.
Figure 2D:
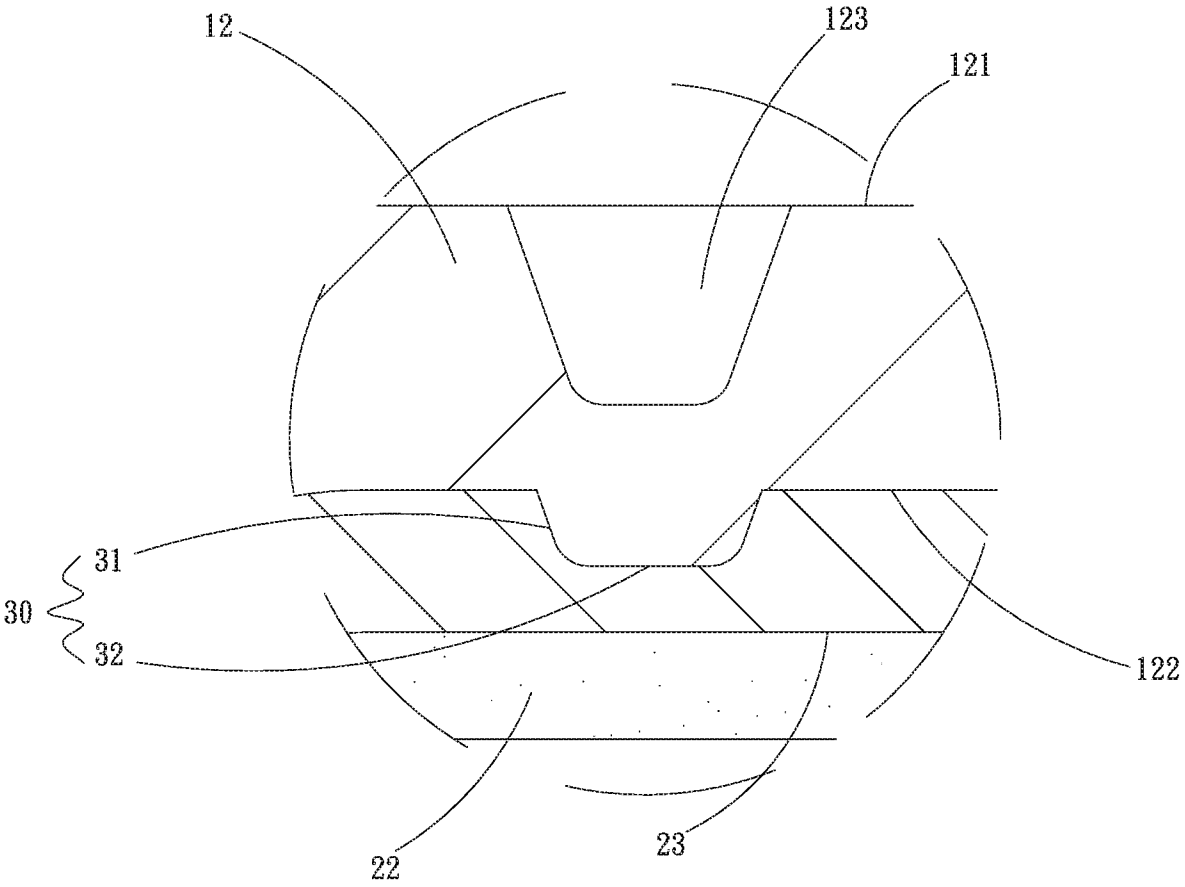
FIG. 2D is an enlarged view of circled area of FIG. 2C.

Please refer to FIGS. 1, 2A, 2B, 2C and 2D. FIG. 1 is a perspective exploded view of a first embodiment of the heat dissipation board and heat pipe of the present invention. FIG. 2A is a perspective assembled view of a first embodiment of the heat dissipation board and heat pipe of the present invention. FIG. 2B is a view of a first embodiment showing that the ribs are formed with deformed recesses. FIG. 2C is a sectional view taken along line 2C-2C of FIG. 2B. FIG. 2D is an enlarged view of circled area of FIG. 2C.

As shown in FIGS. 1 and 2A. The thermal module assembling structure of the present invention includes a heat dissipation board 10 and a heat pipe 20. The heat dissipation board 10 has a receiving channel 11 formed in the heat dissipation board 10. The heat pipe 20 is fitted through the receiving channel 11 and connected with the heat dissipation board 10 by means of press fit. The heat dissipation board 10 is made of metal or alloy material with good thermal conductivity, such as copper, aluminum, gold or silver. The heat pipe 20 can be entirely fitted through the receiving channel 11. Alternatively, only one end of the heat pipe 20 is fitted through the receiving channel 11 (as shown in FIG. 2A). According to the cross section, the heat pipe 20 can be flat-plate heat pipe, circular heat pipe or semicircular heat pipe. According to the configuration, the heat pipe 20 can be a straight heat pipe or a curved heat pipe.

Basically, the heat pipe 20 is a closed chamber containing therein a working fluid. By means of continuous liquid-vapor phase change circulation of the working fluid in the chamber and the convection of the going vapor and coining liquid between the heat absorption end and the heat dissipation end, the heat can be quickly spread through the surface of the chamber to transfer the heat. The operation principle of the heat pipe is that the liquid-phase working fluid absorbs heat at the heat absorption end and evaporates into vapor-phase working fluid. In the instant of evaporation, a local high pressure is created in the chamber to urge the vapor-phase working fluid to flow to the heat dissipation end at high speed. After the vapor-phase working fluid condenses into liquid-phase working fluid at the heat dissipation end, due to the gravity/capillary attraction/centrifugal force of the capillary structure 22 disposed on a inner surface 23 of the heat pipe 20, the liquid-phase working fluid flows back to the heat absorption end to recycle the operation. Therefore, in operation of the heat pipe, the airflow is driven by the air pressure difference, while the liquid flow is driven by a suitable backflow drive force adopted or designed according to the operation state in use. The heat pipe is formed as a closed chamber by means of the pipe body structure.

The pipe body not only should be able to structurally bear the difference between internal pressure and external pressure, but also serves as a medium material for conducting heat into and out of the chamber. Currently, the material of the pipe bodies of most of the small-size heat pipes applied in the electronic heat dissipation field is copper. In consideration of weight or cost, some other heat pipes are made of copper pipe or titanium pipe.

Two sides of upper side of the receiving channel 11 are respectively formed with ribs 12. The ribs 12 horizontally protrude and extend along a surface 13 of the heat dissipation board 10 toward the middle of the receiving channel 11. Each rib 12 has an upper surface 121 and a lower surface 122. The upper surface 121 is positioned on the same level as the surface 13 of the heat dissipation board 10. The lower surface 122 faces a surface 21 of the heat pipe 20 fitted through the receiving channel 11. As shown in FIGS. 2B, 2C and 2D, at least one deformed recess 123 is formed on the upper surface 121 of each of the ribs 12 by means of mechanical processing (pressing, rolling or riveting). In this case, the lower surface 122 of the rib 12 and the surface 21 (not shown) of the heat pipe 20 in contact with the lower surface 122 are deformed. Accordingly, at least one deformed connection section 30 is correspondingly formed between the lower surface 122 of the rib 12 and the surface 21 of the heat pipe 20. In this embodiment, there are multiple deformed recesses 123 arranged along the length of the rib 12 at intervals. The deformed recesses 123 make the lower surfaces 122 of the ribs 12 and the surface 21 of the heat pipe 20 deformed to correspondingly form multiple deformed connection sections 30 between the lower surfaces 122 of the ribs 12 and the surface 21 of the heat pipe 20. Substantially, the deformed connection sections 30 are normal to an axis of the heat pipe 20 (as shown in FIGS. 2C and 2D).

Figure 3A:
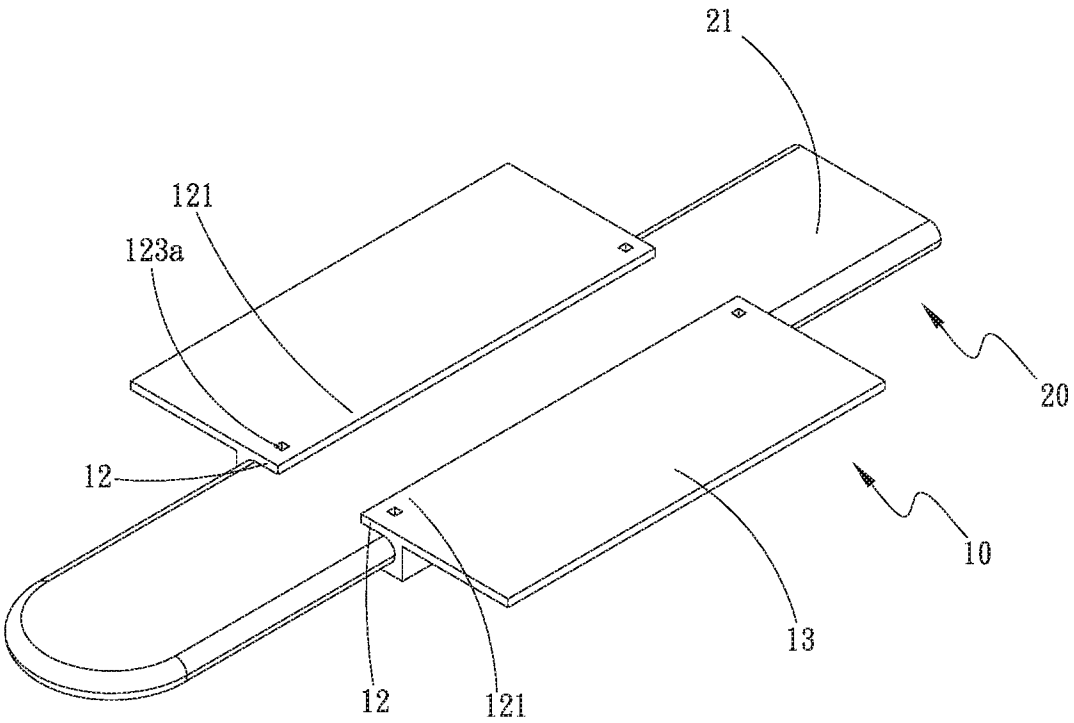
FIG. 3A is a perspective view of a second embodiment of the deformed recesses of the present invention.
Figure 3B:
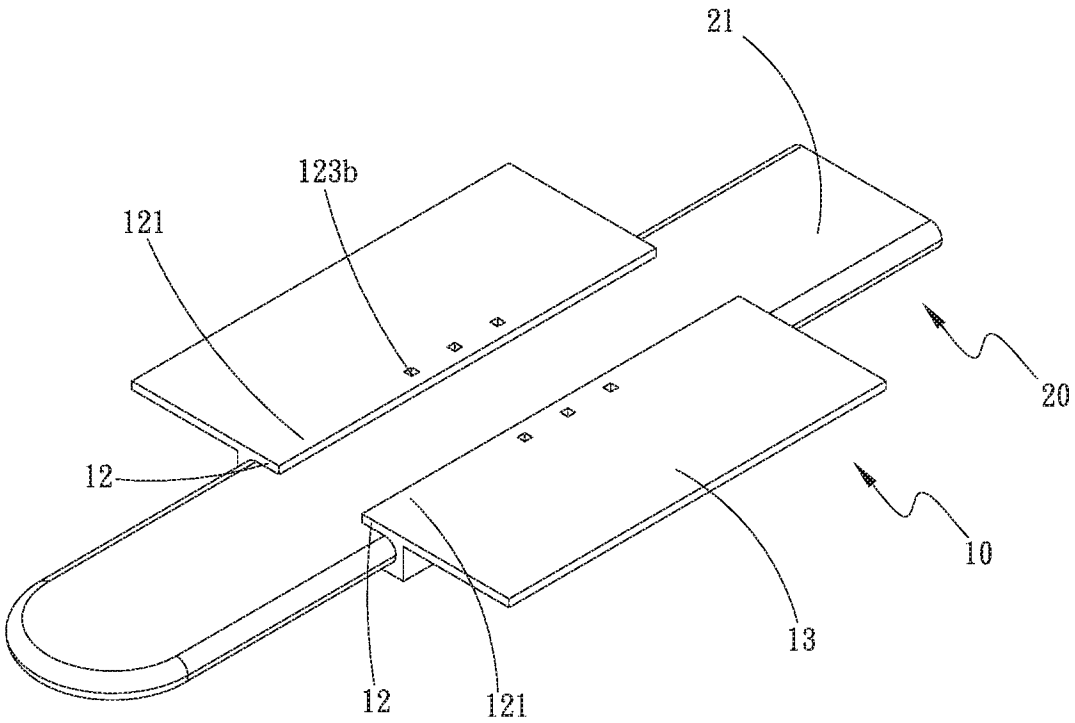
FIG. 3B is a perspective view of a third embodiment of the deformed recesses of the present invention.
Figure 3C:
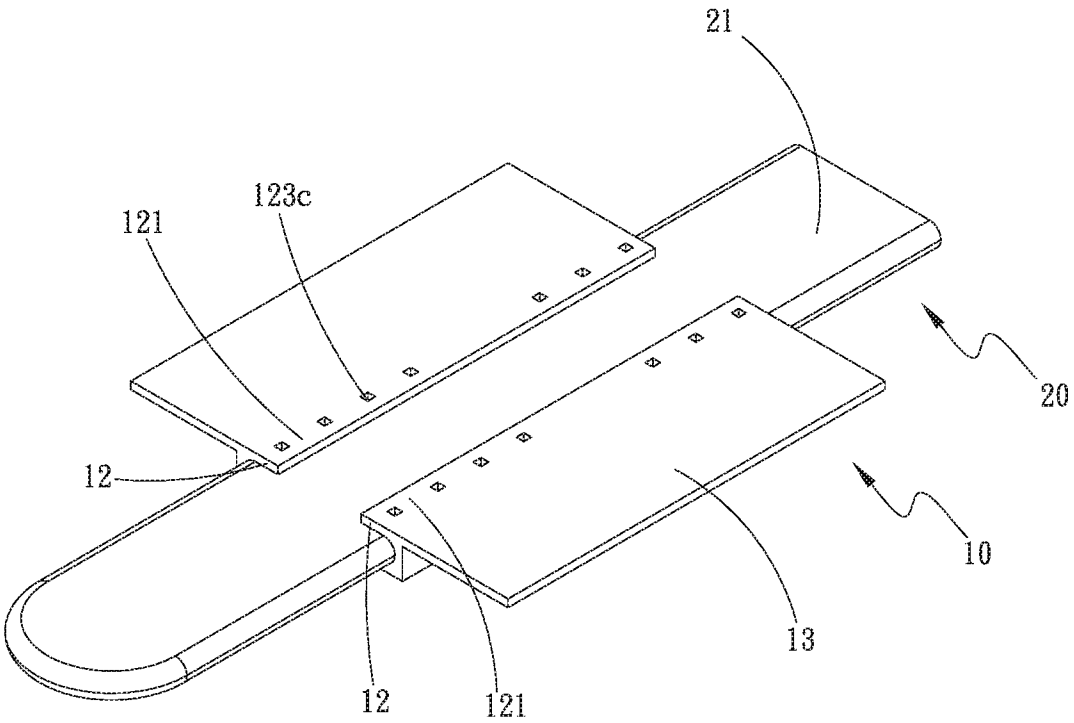
FIG. 3C is a perspective view of a fourth embodiment of the deformed recesses of the present invention.
Figure 3D:
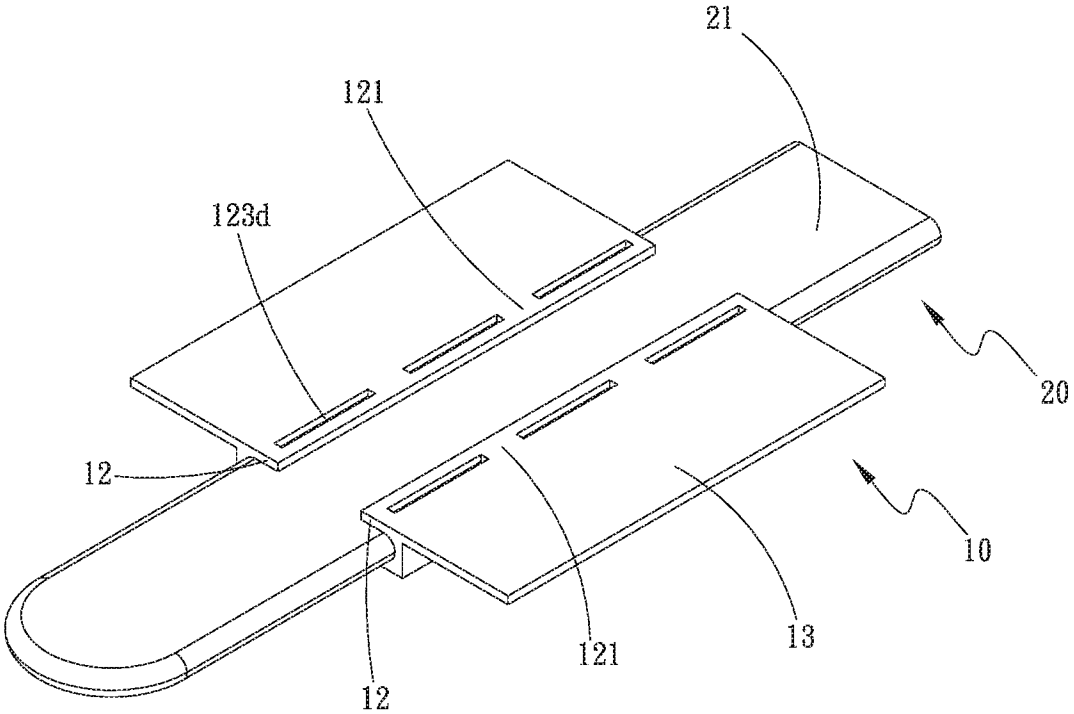
FIG. 3D is a perspective view of a fifth embodiment of the deformed recesses of the present invention.
Figure 3E:
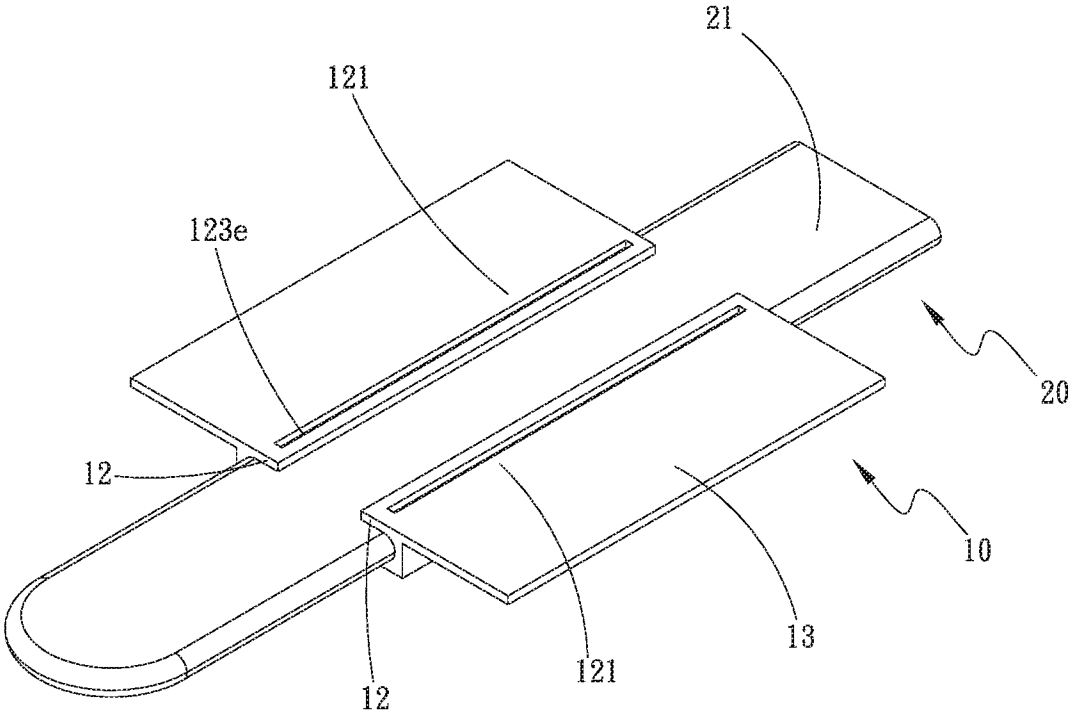
FIG. 3E is a perspective view of a sixth embodiment of the deformed recesses of the present invention.

As aforesaid, the deformed recesses 123 are arranged along the length of the rib 12 at intervals (as shown in FIG. 2B). However, the arrangement of the deformed recesses 123 is not limited to the above. Alternatively, the deformed recesses can be continuous linear recesses or elongated recesses arranged section by section or partially formed on the rib according to requirements. In another embodiment, as shown in FIG. 3A, the deformed recesses 123*a* are disposed on the front edge and rear edge of the rib 12. In still another embodiment, as shown in FIG. 3B, the deformed recesses 123*b* are disposed at the middle of the rib 12. In still another embodiment, as shown in FIG. 3C, the deformed recesses 123*c* are disposed on the front section and rear section of the rib 12. In still another embodiment, as shown in FIG. 3D, the deformed recesses 123*d* are elongated recesses formed on the rib 12 section by section. In still another embodiment, as shown in FIG. 3E, the deformed recesses 123*e* are elongated recesses extending from the front edge to the rear edge of the rib 12.

It should be especially noted that as shown in FIGS. 2B, 2C and 2D, multiple deformed connection sections 30 are locally formed between the mating faces of the ribs 12 and the heat pipe 20 and arranged along the length of the ribs 12 at intervals (as shown in FIGS. 2C and 2D). Each deformed connection section 30 includes a deformed raised portion 31 and a deformed recessed portion 32. The deformed raised portion 31 is formed on the lower surface 122 of the rib 12.

The deformed recessed portion 32 is formed on the surface 21 of the heat pipe 20. By means of the restriction and tight fit and engagement between the deformed raised portion 31 and the deformed recessed portion 32, the surface 21 of the heat pipe 20 fitted in the receiving channel 11 of the heat dissipation board 10 is interfered with. The interference force is normal to the axis of the heat pipe 20 so that the heat pipe 20 is prevented from being extracted out of the receiving channel 11 along the length thereof (in a direction parallel to the axis of the heat pipe 20).

In conclusion, in the present invention, the mating faces of the ribs 12 on two sides of the receiving channel 11 of the heat dissipation board 10 and the heat pipe 20 are locally (or continuously) deformed to form at least one deformed connection section 30 for tightly fitting and connecting the heat pipe 20 with the ribs 12. The deformed connection section 30 is substantially normal to the axis of the heat pipe 20 so as to apply an interference force to the heat pipe 20 to prevent the heat pipe 20 from being extracted out of the receiving channel 11 along the length thereof (in a direction parallel to the axis of the heat pipe 20).

Figure 4A:
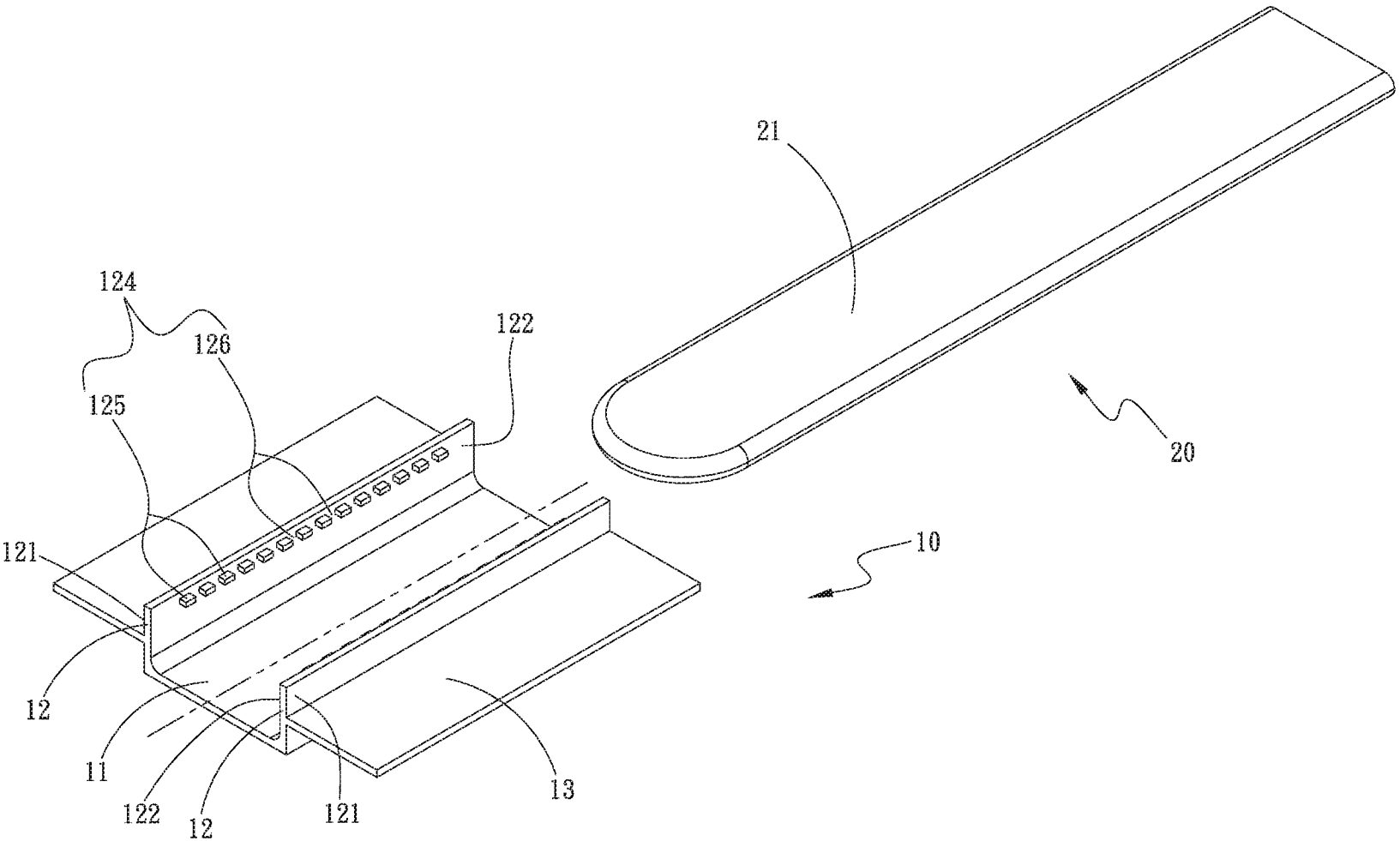
FIG. 4A is a perspective exploded view of a second embodiment of the heat dissipation board and heat pipe of the present invention.
Figure 4B:
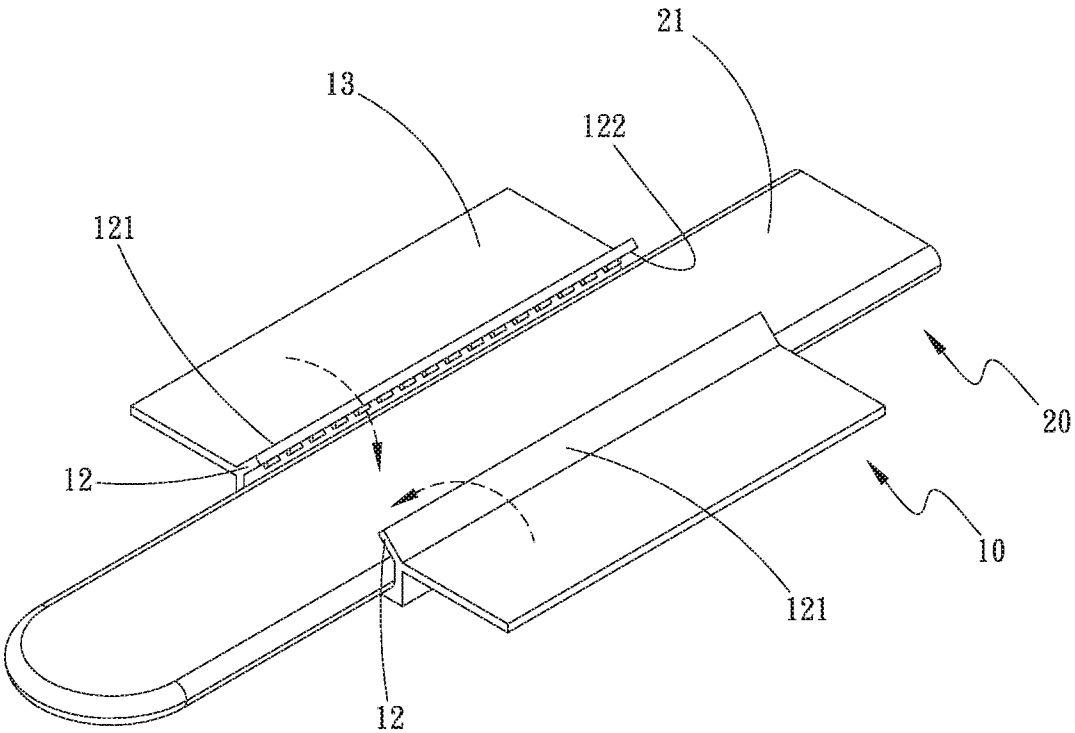
FIG. 4B is a perspective assembled view of a second embodiment of the heat dissipation board and heat pipe of the present invention.
Figure 4C:
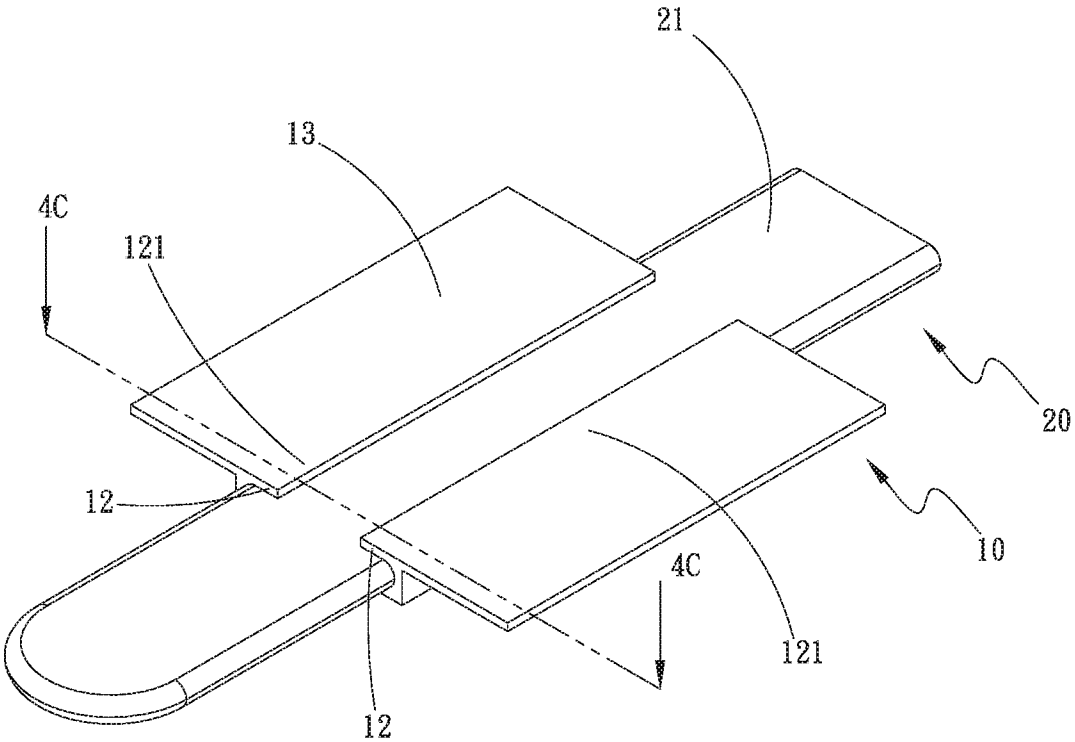
FIG. 4C is a view showing that the ribs are forcing to hold down the heat pipe.
Figure 4D:
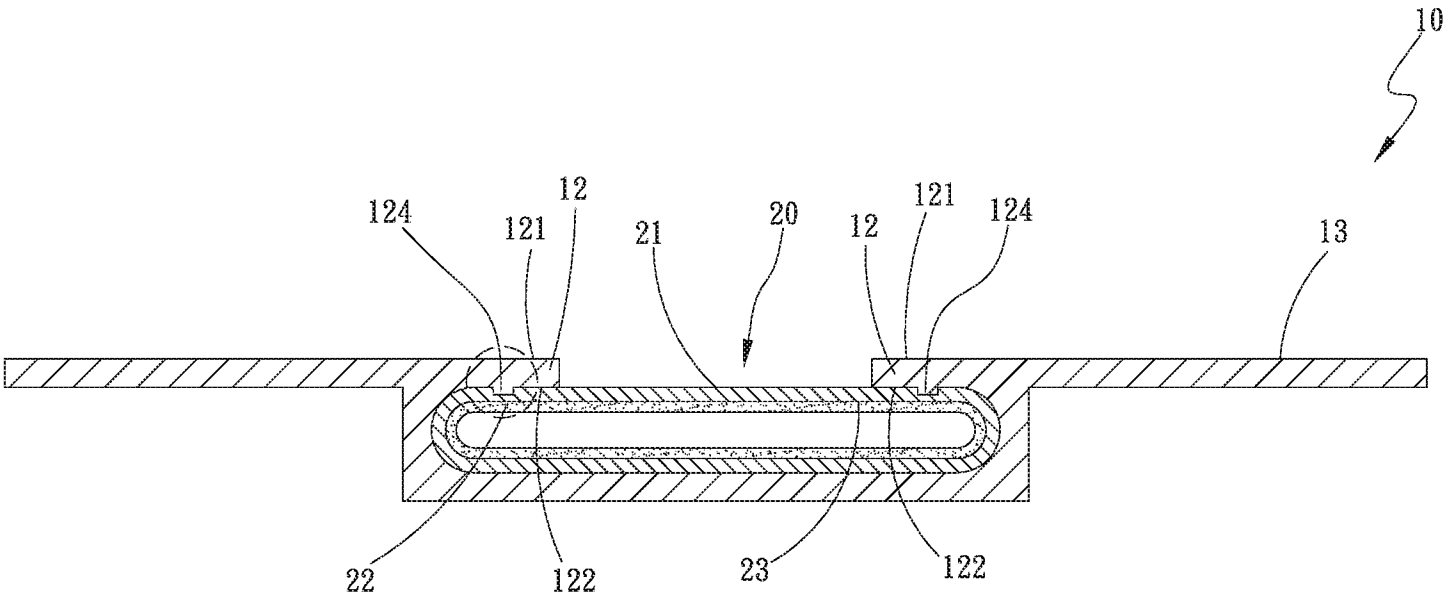
FIG. 4D is a sectional view taken along line 4C-4C of FIG. 4C.
Figure 4E:
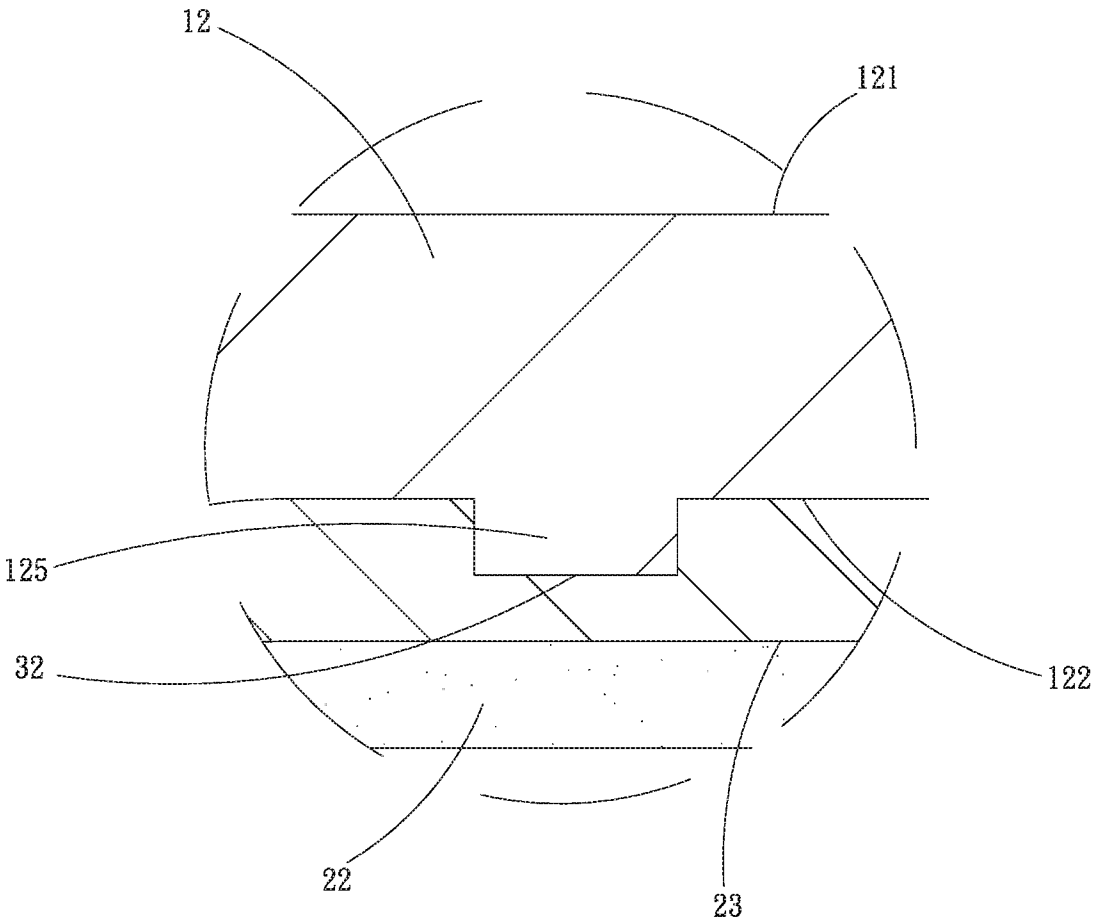
FIG. 4E is an enlarged view of circled area of FIG. 4D.

Please refer to FIGS. 4A to 4E. FIG. 4A is a perspective exploded view of a second embodiment of the heat dissipation board and heat pipe of the present invention. FIG. 4B is a perspective assembled view of a second embodiment of the heat dissipation board and heat pipe of the present invention. FIG. 4C is a view showing that the ribs are forcing to hold down the heat pipe. FIG. 4D is a sectional view taken along line 4C-4C of FIG. 4C. FIG. 4E is an enlarged view of circled area of FIG. 4D.

Also supplementally referring to FIGS. 2A to 2D, the second embodiment of the present invention is partially identical to the first embodiment in structure and function and thus will not be redundantly described hereinafter. The second embodiment is different from the first embodiment in that in the first embodiment, two sides of upper side of the receiving channel 11 of the heat dissipation board 10 are respectively formed with the ribs 12. The ribs 12 horizontally protrude and extend toward the middle of the receiving channel 11, while in the second embodiment, the ribs 12 are, but not limited to, uprightly disposed. Alternatively, in another embodiment, the ribs 12 can be 45-degree inclined.

An elevated and sunken area 124 is disposed on the lower surface 122 of each rib 12. The elevated and sunken area 124 has multiple elevated sections 125 and at least one sunken section 126. The elevated sections 125 and the at least one sunken section 126 are alternately arranged. In a modified embodiment, the elevated and sunken area 124 has at least one elevated section 125 and multiple sunken sections 126. The sunken sections 126 and the at least one elevated section 125 are alternately arranged. Alternatively, the elevated and sunken area 124 has multiple elevated sections 125 and multiple sunken sections 126. The elevated sections 125 and the sunken sections 126 are alternately arranged.

The heat pipe 20 is fitted through and received in the receiving channel 11. When a downward pressing force is applied to the ribs 12, the lower surfaces 122 of the ribs 12 are pressed against the heat pipe 20 (as shown by the phantom-line arrows in FIG. 4B). Under such circumstance, the elevated and sunken areas 124 of the two ribs 12 are inlaid into the surface 21 of the heat pipe 20, whereby the surface 21 of the heat pipe 20 is deformed to form multiple deformed recesses 32. The elevated sections 125 of the elevated and sunken areas 124 are tightly fitted and connected in the deformed recesses 32.

In this embodiment, the elevated and sunken areas 124 are arranged along the length of the ribs 12 at intervals. The elevated and sunken areas 124 make the lower surfaces 122 of the ribs 12 and the surface 21 of the heat pipe 20 deformed. In addition, the elevated sections 125 of the elevated and sunken areas 124 and the deformed recesses 32 are substantially normal to an axis of the heat pipe 20 (as shown in FIGS. 4D and 4E).

Figure 5A:
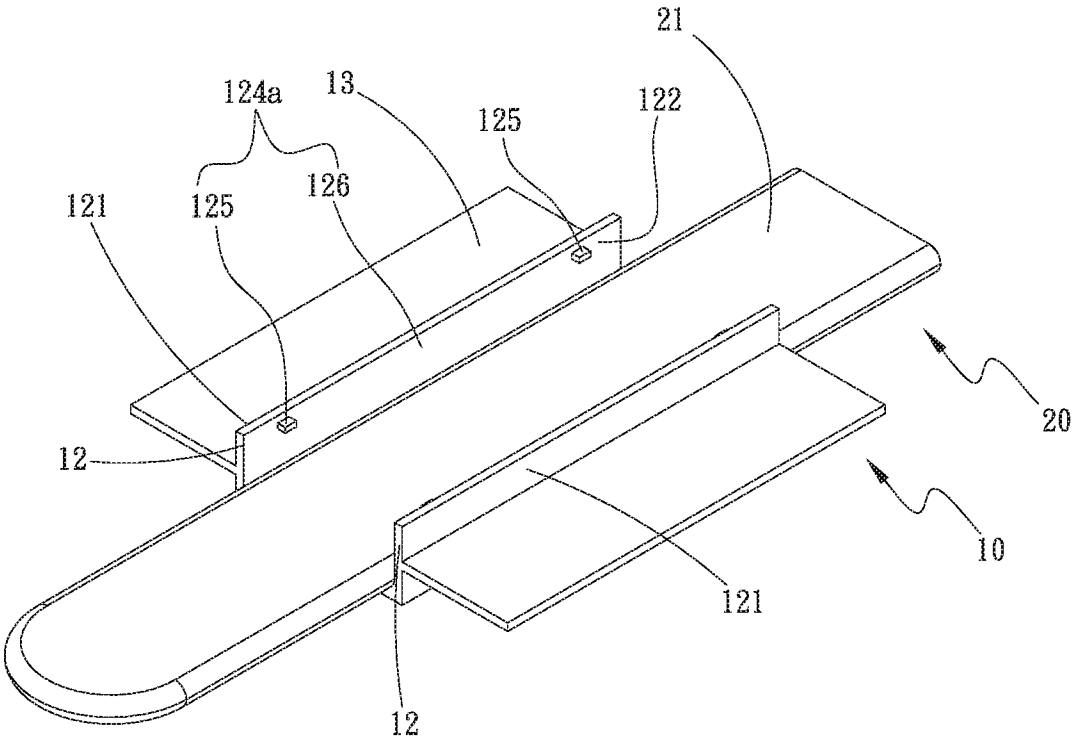
FIG. 5A is a perspective view of a second embodiment of the alternating elevated and sunken areas.
Figure 5B:
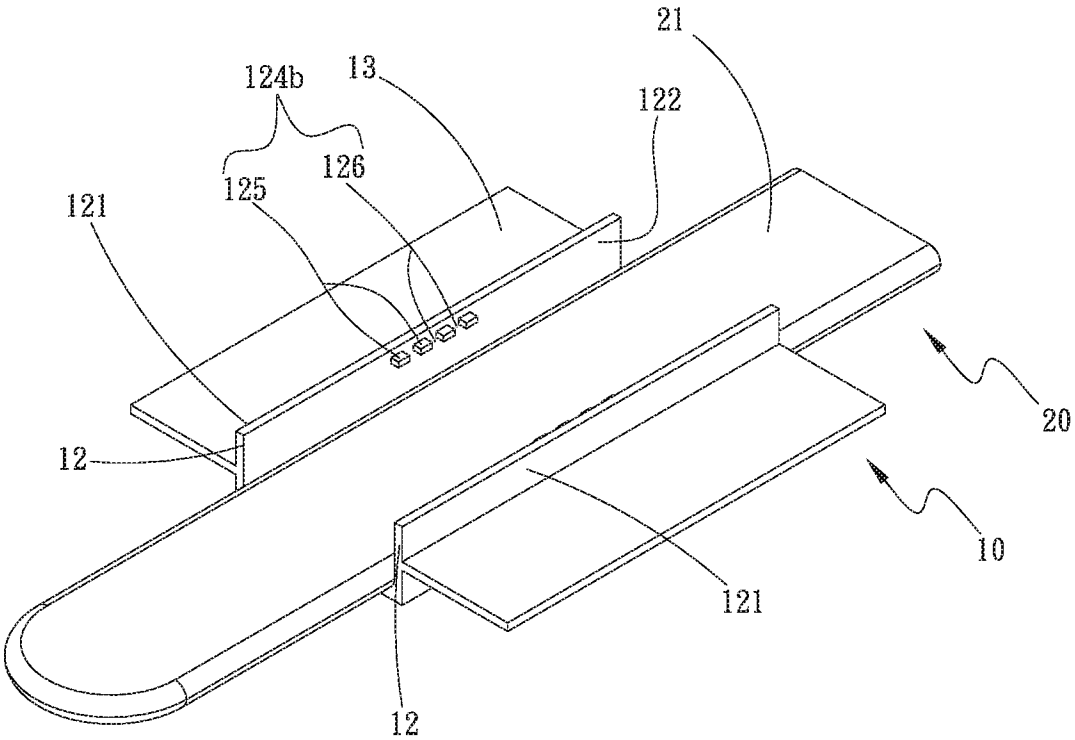
FIG. 5B is a perspective view of a third embodiment of the alternating elevated and sunken areas.
Figure 5C:
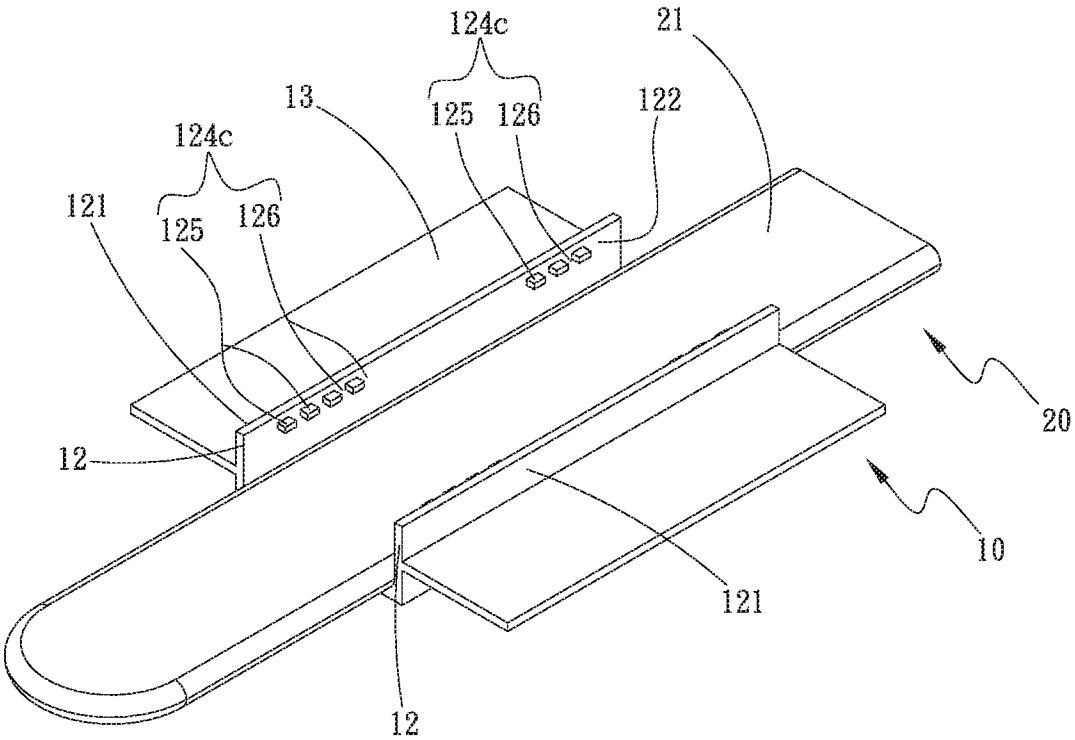
FIG. 5C is a perspective view of a fourth embodiment of the alternating elevated and sunken areas.
Figure 5D:
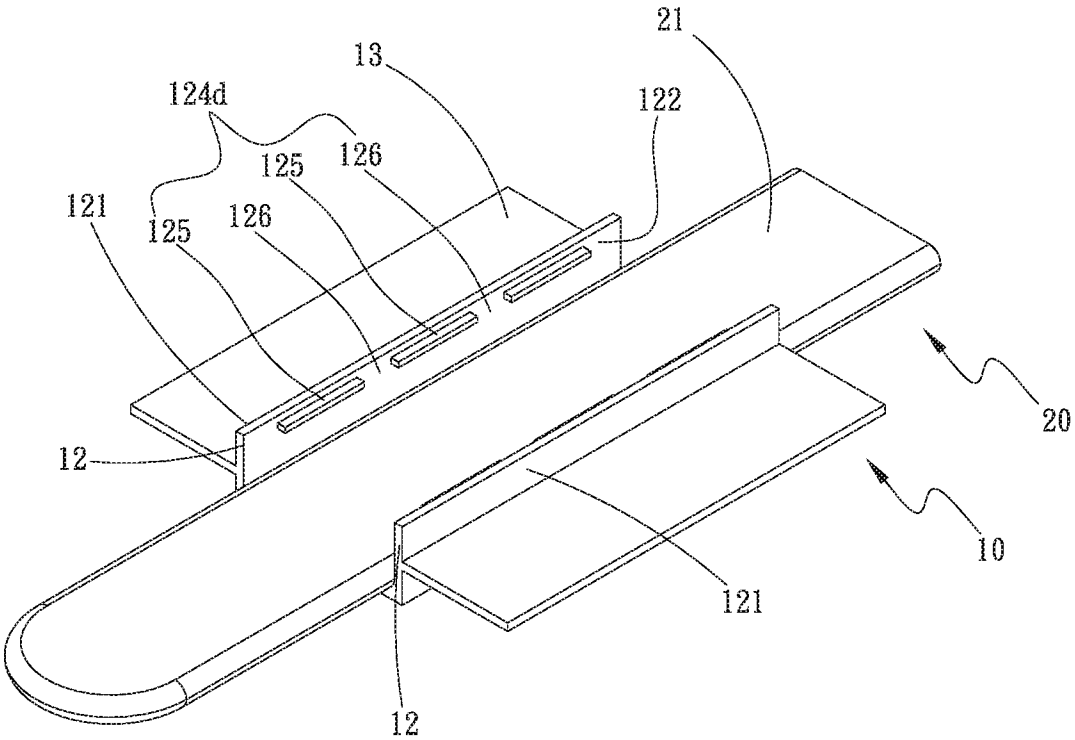
FIG. 5D is a perspective view of a fifth embodiment of the alternating elevated and sunken areas.
Figure 5E:
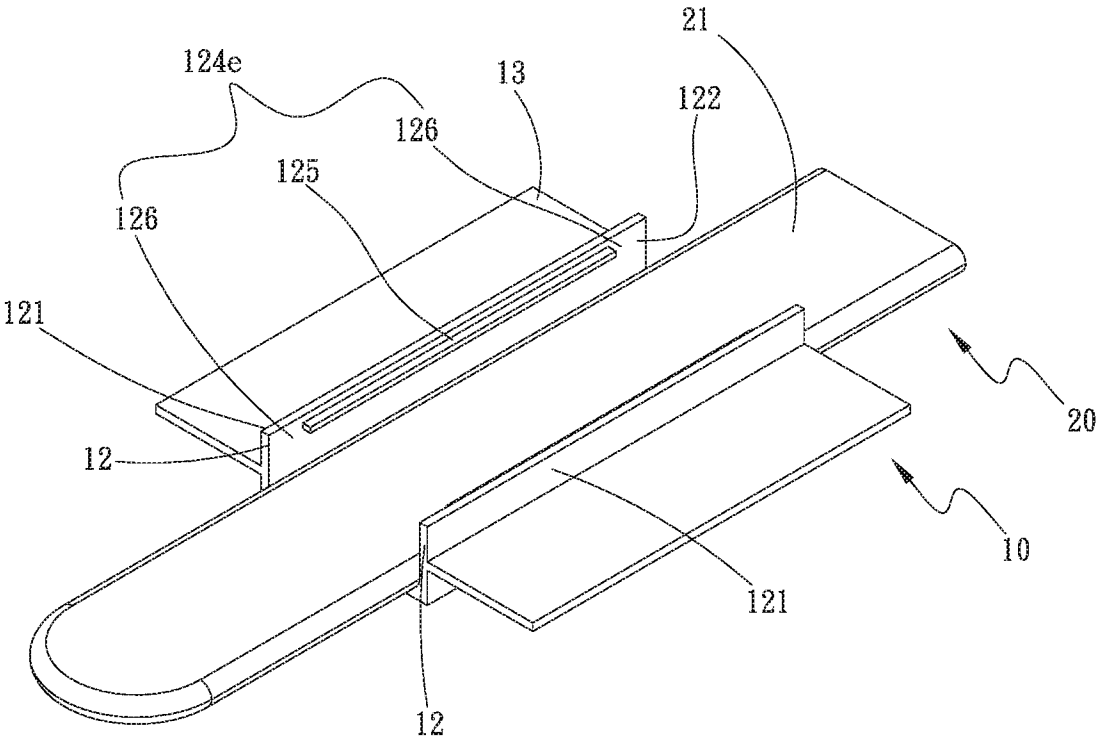
FIG. 5E is a perspective view of a sixth embodiment of the deformed recesses of the present invention.

In the above embodiment, the elevated and sunken areas 124 are arranged along the length of the ribs 12 at intervals (as shown in FIG. 4A). However, the arrangement of the elevated and sunken areas 124 is not limited to this. Alternatively, the elevated and sunken areas 124 can be continuous linear elevated and sunken areas or elongated elevated and sunken areas arranged section by section or partially formed on the rib according to requirements. In a preferred embodiment as shown in FIG. 5A, the elevated and sunken areas 124*a* are disposed on the front edge and rear edge of the rib 12. In another embodiment as shown in FIG. 5B, the elevated and sunken areas 124*b* are disposed at the middle of the rib 12. In still another embodiment as shown in FIG. 5C, the elevated and sunken areas 124*c* are disposed on the front section and rear section of the rib 12. In still another embodiment as shown in FIG. 5D, the elevated and sunken areas 124*d* are elongated elevated and sunken areas formed on the rib 12 section by section. In still another embodiment as shown in FIG. 5E, the elevated and sunken areas 124*e* are elongated elevated and sunken areas.

As aforesaid, the elevated sections 125 of the elevated and sunken areas 124 are pressed against the surface 21 of the heat pipe 20, whereby the surface 21 of the heat pipe 20 is deformed to form multiple deformed recesses 32. The elevated sections 125 of the elevated and sunken areas 124 are confined and tightly fitted and connected in the deformed recesses 32. The surface 21 of the heat pipe 20 fitted in the receiving channel 11 of the heat dissipation board 10 is interfered with. The interference force is normal to the axis of the heat pipe 20 so that the heat pipe 20 is prevented from being extracted out of the receiving channel 11 along the length thereof (in a direction parallel to the axis of the heat pipe 20).

Figure 6:
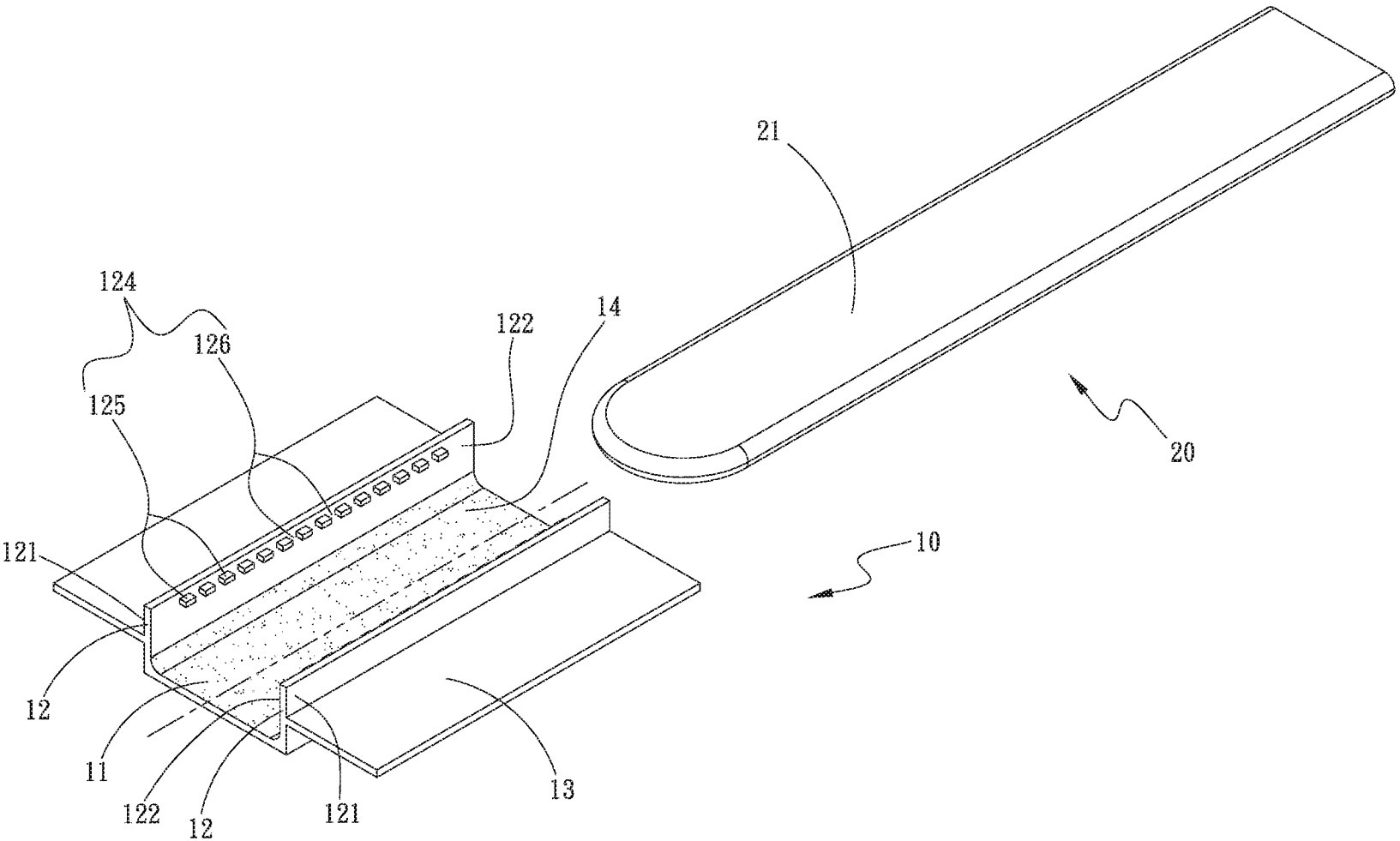
FIG. 6 is a perspective exploded view of a third embodiment of the heat dissipation board and heat pipe of the present invention.

Please now refer to FIG. 6, which is a perspective exploded view of a third embodiment of the heat dissipation board and heat pipe of the present invention. Also supplementally referring to FIGS. 4A to 4E, the third embodiment of the present invention is partially identical to the first embodiment in structure and function and thus will not be redundantly described hereinafter. The third embodiment is different from the first embodiment in that in that the receiving channel 11 of the heat dissipation board 10 has a coarse surface 14 for increasing the frictional force between the receiving channel 11 and the surface 21 of the heat pipe 20. In this case, the heat pipe 20 is hard to be extracted out of the receiving channel 11 along the length thereof (in a direction parallel to the axis of the heat pipe 20).

The present invention has been described with the above embodiments thereof and it is understood that many changes and modifications in the above embodiments can be carried out without departing from the scope and the spirit of the invention that is intended to be limited only by the appended claims.

What is claimed is:

1. A thermal module assembling structure comprising:

a heat dissipation board having a receiving channel formed in the heat dissipation board and a heat pipe inserted through the receiving channel, opposed sides of an upper surface of the receiving channel being respectively formed with ribs, each rib having an upper surface and a lower surface, the lower surface of each rib having a pattern of alternating elevated and sunken areas, the lower surface of the ribs being bent under a force to engage the heat pipe, the force being sufficient to create dented areas on a surface of the heat pipe in contact with the alternating elevated and sunken areas on the ribs, to firmly engage the pattern of alternating elevated and sunken areas;

wherein the pattern of the alternating elevated and sunken areas have multiple raised sections and at least one recessed section being rounded, square or a rectangle, the multiple raised sections and at least one recessed section alternating along a length of the heat pipe and dented into the heat pipe to restrict a movement of the heat pipe.

2. The thermal module assembling structure as claimed in claim 1, wherein the multiple raised sections and at least one recessed section arranged alternately, multiple raised sections are firmly engaged with multiple dented recessed portions.

3. The thermal module assembling structure as claimed in claim 2, wherein multiple raised sections and at least one recessed section of the pattern of alternating elevated and sunken areas are substantially normal to an axis of the heat pipe.

4. The thermal module assembling structure as claimed in claim 1, wherein the pattern of alternating elevated and sunken areas have multiple recessed sections and at least one raised section arranged alternately, the at least one raised section being firmly engaged with multiple indented recessed portions.

5. The thermal module assembling structure as claimed in claim 4, wherein multiple raised sections and at least one recessed section of the pattern of alternating elevated and sunken areas are substantially normal to an axis of the heat pipe.

6. The thermal module assembling structure as claimed in claim 1, wherein the receiving channel has a coarse surface.

* * * * *